US008074295B2

(12) United States Patent
Albiero et al.

(10) Patent No.: US 8,074,295 B2
(45) Date of Patent: Dec. 13, 2011

(54) STRETCHABLE FABRIC SUITABLE FOR SWIMWEAR APPLICATIONS

(75) Inventors: Federica Albiero, La Pineda (ES); Fabio D'Ottaviano, Cambrils (ES); Jose M. Rego, Houston, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 12/299,059

(22) PCT Filed: Apr. 30, 2007

(86) PCT No.: PCT/US2007/010564

§ 371 (c)(1), (2), (4) Date: Oct. 30, 2008

(87) PCT Pub. No.: WO2007/130420

PCT Pub. Date: Nov. 15, 2007

(65) Prior Publication Data

US 2009/0071197 A1 Mar. 19, 2009

(51) Int. Cl.
*A41D 1/00* (2006.01)

(52) U.S. Cl. ..... 2/67

(58) Field of Classification Search ..... 2/67, 2.15–2.17, 2/69, 227–238; 66/171–176
See application file for complete search history.

(56) References Cited

U.S. PATENT DOCUMENTS

| | | | | |
|---|---|---|---|---|
| 5,052,053 | A * | 10/1991 | Peart et al. | 2/2.16 |
| 5,948,875 | A | 9/1999 | Liu et al. | |
| 6,098,198 | A * | 8/2000 | Jacobs et al. | 2/69 |
| 6,437,014 | B1 | 8/2002 | Ho et al. | |
| 6,472,494 | B2 | 10/2002 | Houser et al. | |
| 6,484,319 | B1 * | 11/2002 | Fusco et al. | 2/67 |
| 6,546,560 | B2 * | 4/2003 | Fusco et al. | 2/67 |
| 6,647,550 | B1 * | 11/2003 | Matsuzaki et al. | 2/67 |
| 2005/0164577 | A1 | 7/2005 | Reid et al. | |
| 2006/0021387 | A1 | 2/2006 | Chuang et al. | |

FOREIGN PATENT DOCUMENTS

| | | |
|---|---|---|
| EP | 1 541 729 | 6/2005 |
| JP | 2005-120523 | 5/2005 |
| WO | WO-03/040442 A1 | 5/2003 |
| WO | WO-2005/090425 A1 | 9/2005 |
| WO | WO-2005/090426 A1 | 9/2005 |
| WO | WO-2005/090427 | 9/2005 |
| WO | WO-2006/020940 | 2/2006 |

OTHER PUBLICATIONS

International Search Report (PCT/US2007/010564).

* cited by examiner

*Primary Examiner* — Larry Worrell, Jr.

(57) ABSTRACT

The present invention relates to new fabric designed for improved utility in swimwear applications, as well as the method for producing such fabric as well as garments made from such fabrics. The fabric can be characterized in terms elongation, instantaneous fabric growth at 15% strain and dimensional stability. The fabric comprises an elastic crosslinked polyolefin elastic yarn and a second yarn selected from the group consisting of polyester, nylon, and polypropylene.

20 Claims, No Drawings

STRETCHABLE FABRIC SUITABLE FOR SWIMWEAR APPLICATIONS

The present invention relates to new fabric designed for improved utility in swimwear applications, as well as the method for producing such fabric as well as garments made from such fabrics. The fabric can be characterized in terms elongation, instantaneous fabric growth at 15% strain and dimensional stability. The fabric comprises a crosslinked polyolefin elastic fiber and a second fiber selected from the group consisting of polyester, nylon, and polypropylene.

BACKGROUND AND SUMMARY OF THE INVENTION

Swimwear is a segment of the garment industry which is known to have special needs and requirements. Swimwear is typically constructed from knit fabrics as knit fabrics can more easily conform to the body by compressing or elongating the individual knit stitches that form the knit fabric. However, the ability of the stitches to conform or elongate also leads to deformations such as bagging, particularly in areas where the garment is subjected to more stretching, unless the fabric has the ability to return the knit stitches to their original dimensions. These deformation tend to become exaggerated in an aqueous environment such as encountered in swimming. Bagging is not only unsightly, but also increases the drag as the swimmer moves through the water. Accordingly, it is desired to produce a knit fabric having elastomeric properties such that swimwear or other garments made from the fabric will be more dimensionally stable.

Fabrics containing elastic fiber are well known. It is now common to co-knit a relatively small amount of an elastic fiber such as spandex with a companion hard yarn. Due to the nature of most elastic fibers, a heat setting step is usually required to maintain dimensional stability. Without such heat-setting, the elastic fiber will retract to compress the fabric stitches, thereby reducing the overall dimensions. Heat setting is known to have several disadvantages including cost, and undesired reactions of the elastic and/or companion yarns to the heat. To combat the reaction to the heat, elastic fibers that can be heat-set at somewhat lower temperatures have been identified (see, for example U.S. Pat. Nos. 5,948,875 or 6,472,494). Another approach was reported in US2006/0021387 A1, which discloses circular knit elastic fabrics which include a bare elastomeric material such as spandex plated with spun or continuous filament hard yarns. The fabric is subjected to an aqueous setting procedure referred to as "hydro-setting", under particular temperature and pressure conditions. It is desired to have a dimensionally stable fabric which does not require traditional high temperature heat-setting or hydro setting.

US2005/0164577 A1 discloses circular knit stretch fabrics made from crosslinked olefinic elastic fiber. These fabrics show improved growth characteristics but still lack the desired dimensional stability. Accordingly it is desired to have a fabric with even greater dimensional stability, particularly under conditions such as those encountered by competitive swimmers. It is also desirable to have improved dimensional stability to allow for greater flexibility in final garment treatments such as printing.

It has been discovered that improved fabrics comprising elastic fiber together with hard companion yarns can be obtained by using knitting conditions such as feed rates and fine gauge needles to produce a fine tight loop. Moreover, it has also been discovered that dimensional stability can be improved by selecting hard yarns that exhibit an inherent elastic response, either as a result of chemical nature of the fiber or which has been introduced during the fiber production process, such as a texturization process.

Accordingly, one aspect of the present invention is an elastic fabric characterized in that it has an Elongation greater than 90%, an instantaneous fabric growth at 15% strain of 7% or less, a Dimensional Stability for each of the length and the width of ±7%, wherein the fabric comprises from 6% to 50% by weight of a first fiber which is a crosslinked polyolefin fiber of from 11 to 99 dtex, and from 50% to 94% by weight of a second fiber which is a fiber of from 22 to 176 dtex selected from the group consisting of polyester, nylon, and polypropylene.

Another aspect of the present invention is a garment, particularly swimwear, made from the preferred fabric of the invention.

Still another aspect of the present invention is a method for making a dimensionally stable elastic fabric comprising combining a first fiber which is a crosslinked polyolefin fiber of from 11 to 99 dtex, and a second fiber selected from the group consisting of polyester, nylon, and polypropylene which second fiber is a fiber of from 22 to 176 dtex under knitting conditions suitable to produce a fine tight loop (e.g. 1000 to 1600 mm/rack for the hard yarn with 200 to 1000 mm/rack for the elastic yarn).

DETAILED DESCRIPTION OF THE INVENTION

The following terms shall have the indicated meaning when used in the present patent application:

"Fiber" means a material in which the length to diameter ratio is greater than about 10. Fiber is typically classified according to its diameter. Filament fiber is generally defined as having an individual fiber diameter greater than about 15 denier (17 dtex), usually greater than about 30 denier (33 dtex). Fine denier fiber generally refers to a fiber having a diameter less than about 15 denier. Microdenier fiber is generally defined as a multifilament fiber having less than about 0.9 denier (1 dtex) per filament.

"Filament fiber" or "monofilament fiber" means a single, continuous strand of material of indefinite (i.e., not predetermined) length, as opposed to a "staple fiber" which is a discontinuous strand of material of definite length (i.e., a strand which has been cut or otherwise divided into segments of a predetermined length).

The term "yarn" includes both a monofilament fiber as well as a number of fibers twisted or otherwise joined together to form a continuous strand.

An "elastic fiber" is one that will recover at least about 50 percent, more preferably at least about 60% even more preferably 70% of its stretched length after the first pull and after the fourth to 100% strain (double the length). One suitable way to do this test is based on the one found in the International Bureau for Standardization of Manmade Fibers, BISFA 1998, chapter 7, option A. Under such a test, the fiber is placed between grips set 4 inches apart, the grips are then pulled apart at a rate of about 20 inches per minute to a distance of eight inches and then allowed to immediately recover. It is preferred that the elastic textile articles of the present invention have a high percent elastic recovery (that is, a low percent permanent set) after application of a biasing force.

"Elastic materials" are also referred to in the art as "elastomers" and "elastomeric". For purposes of this invention, an "elastic article" is one that comprises elastic fiber.

"Nonelastic" or "Hard" fiber means a fiber, that is not elastic as defined above. It should be understood that despite being termed "nonelastic" these fibers are not necessarily rigid and may have the ability to be stretched to some extent under a biasing force and may exhibit some recovery when the biasing force is released after such stretching.

"Core spun yarn" means a yarn which has been made by twisting fibers around a core which is another filament or a previously spun yarn, thus at least partially concealing the core.

The term "Elongation" means the amount the fabric lengthens after applying a load over a given length of time expressed as a percentage of the initial fabric dimension. Elongation is determined using the following procedure. Three fabric samples, each of 10 cm length and 5 cm width, are subject to two load (to 36N) and unload (to 0% elongation) cycles lengthwise, one sample at a time, in an Instron Universal testing Machine with the strain rate set at 400 mm/min. The elongation is measured as the average extension of the three samples at 36N load in the second cycle. The test is performed with samples cut in cross (or width) and machine (or length) direction and each direction attains its own value of elongation (Em=elongation machine direction; Ec=elongation cross direction). The overall fabric Elongation ($E_f$) is then calculated according to the formula:

$$E_f=\sqrt{E_m^2+E_c^2}.$$

The term "Modulus" when referring to the fabrics of the present invention means the load required to stretch the fabric 40% on the second stretch cycle in the above described procedure for elongation. The average of the three samples load at 40% elongation in the second load cycle is here called "Modulus". Each fabric direction attains its own modulus value (Mm=modulus machine direction; Mc=modulus cross direction). The overall fabric Modulus ($M_f$) is then calculated according to the formula:

$$M_f=\sqrt{M_m^2+M_c^2}.$$

The term "Growth" when referring to fabrics of the present invention refers to dimensional changes of the fabric under prolonged strain conditions. Growth is evaluated in this patent as follows: First, sample specimens are cut from the fabric: one on machine direction and the other one on cross direction. The short dimension of the specimen is always cut 10 cm in length whereas the long dimension varies depending on the level of strain at which the growth will be measured. Typically, three strain levels are evaluated: 15%, 25% and 35%. Second, the samples are converted into loops by sewing the extremes of the long dimension in such a manner as to ensure that the ends do not separate during testing. Next, two sets of marks are made with a ruler and a pen marker on the surface of the sample specimen; one in the front or top of the loop layer and another one in the back or bottom of the loop. Then, both ends of the loops are fixed to a frame with two protruding ends long enough to ensure that the entire loop fits over the protruding end. The protruding ends are at a fixed distance apart from each other. Given the distance between these protruding ends, the size of the loop can be set so as to achieve the desired strain (typically 15%, 25% and 35%) when the loop is stretched to reach both protruding ends. The stretched specimens can be placed in air ("dry growth") or in water (tap water is used for the present invention but it could be, for example, a chlorine solution —"wet growth"). The specimens are kept under this strain and environmental condition (dry or wet) for 24 hours at room temperature. After 24 hours, the specimens are taken out of the environment selected (dry or wet) and removed from the frame and the distance between marks is measured after 1 minute (sometimes referred to as "instantaneous growth") and again after 24 hours (unless otherwise stated, the distance after 1 minute is the measurement referred to in the present application). The growth at a given time and a given direction (machine or cross) is calculated as: ((distance after exposure−initial distance)/initial distance)*100 in machine and cross direction. The overall Fabric Growth ($G_f$) is calculated as $\sqrt{Gm^2+Gc^2}$ where $G_m$ is growth in machine direction and $G_c$ is the growth in cross direction.

"Fabric Width" is determined by the average of three measurements of distance between the two edges of the fabric in cross direction.

The "Fabric Density" for the fabrics of the present invention are determined by the average of the mass per unit area of samples taken from the left fabric side, the right fabric side and the center of the fabric. The sample dimension is 100 $cm^2$.

"Dimensional Stability" means the level of fabric shrinkage during a hot wash and tumble drying sequence. It is measured following the standard AATCC 135-1999 type 1; V; Ai. in cross and machine directions.

The fabric of the present invention comprises from about 6% to about 50% by weight of a first yarn which is elastic and which comprises a crosslinked polyolefin fiber of from 11 to 99 dtex. Polyethylene and polypropylene based fibers are preferred with polyethylene based fibers being more preferred. It is preferred that the polyolefin fibers comprise a primary olefin such as ethylene or propylene as well as an additional $C_2$-$C_{20}$ alpha-olefin as a copolymer. For ethylene copolymers the comonomer is preferably 1-butene, 1-hexene or 1-octene with 1-octene being generally preferred for many applications. The first yarn may have a random, block, or pseudo block (such as the segmented ethylene-alpha-olefin block copolymers discussed for example in WO 2005/090427, WO 2005/090425 and WO 2005/090426, each of which are hereby incorporated by reference in their entirety) microstructure. The first yarn may also comprise more than one polyolefin.

The first yarn may be crosslinked via any suitable technology such as e-beaming UV crosslinking, or silane crosslinking. The Crosslinking level can range from about 10 to about 100% The crosslinking level for polyethylene materials is conveniently determined as the percent insoluble in a Soxhlet extraction in boiling xylene in accordance with ASTM D-2765.

The first yarn of the present invention preferably comprises a polyolefin having a melting point as determined by using differential scanning calorimetry (DSC).of from about 30° C. to about 170° C., more preferably 40° C. to 150° C., most preferably 45° C. to 140° C.

The first yarn may also include one or more various additives as is generally known in the art. Such additives include antioxidants, pigments or dyes, friction coefficient modifiers, or processing aids.

Fibers made from cross linked homogeneously branched ethylene polymers are particularly preferred. These fibers are described in U.S. Pat. No. 6,437,014, (which is hereby incorporated by reference in its entirety) and is generically known as lastol. Such fibers are available from The Dow Chemical Company under the trade name DOW XLA™ fibers.

It is preferred that the first yarn be a monofilament fiber, but the yarn may be multifilament or may be a covered yarn such as a core spun yarn where the elastic fiber comprises the core, and a hard yarn such as a polyester is wrapped around the core.

If the first yarn is the preferred monofilament elastic fiber or a multifilament elastic fiber then it will have a count ranging from 11 to 99 dtex, preferably from 17 to 94 dtex and most preferably from 22 to 88 dtex, as determined by standard industry methods known to the person skilled in the art. The fabric of the present invention will comprise about 6% to about 50% by weight of the first yarn, preferably 9 to 40% This weight percent is based upon the total content of all elastic yarn, if more than one type of elastic yarn is used as the "first" yarn.

The fabric of the present invention also comprises from 50 to 94% by weight of a second yarn which is a nonelastic fiber of from 22 to 176 dtex selected from the group consisting of polyester, nylon, and polypropylene. Polyester yarn includes materials such as polyethylene terephthalate (PET), polybutylene terephthalate (PBT) and poly(trimethylene) terephthalate (PTT). Nylon includes both Nylon 6 and Nylon 6,6. Polypropylene includes homopolymer polypropylene, random copolymer polypropylene, impact modified polypropylene, segmented block copolymers, functionalized homopolymers or copolymers and propylene based elastomers and plastomers, such as those described in WO03/040442, and U.S. application 60/709,688 filed Aug. 19, 2005 (each of which is hereby incorporated by reference in its entirety). The second yarn can be a flat or a textured fiber with textured fibers generally being more preferred. "Textured" fibers means that the fiber is subject to a mechanical twist as is known to the skilled artisan. This mechanical twisting imparts a slight amount of elasticity to the fiber.

The second yarn can be monofilament or multi-filament fibers. The second yarn will have a count ranging from 22 to 176 dtex, preferably from 28 to 165 dtex and most preferably from 33 to 156 dtex, as determined by standard industry methods known to the person skilled in the art. The fabric of the present invention will comprise about 50% to about 94% by weight of the second yarn, preferably about 60 to 91% by weight of the fabric. This weight percent is based on the total content of nonelastic yarns used as the "second" yarn. It should be understood that more than one type of nonelastic yarn may be used. It should also be understood that yarns other than those selected from the group consisting of polyester, nylon, and polypropylene (for example, cellulosic based fibers) may be used in the fabric of the present invention, and thus the weight percent of the first fiber and the second fiber does not have to equal 100%.

The fabrics of the present invention can be made in any suitable manner, however, it is most preferred that the fabrics be made using knitting process such as warp knitting (including locknit, single tricot and double tricot construction) or circular knitting (including Single jersey, Rib and Interlock structures).

In knitting processes, it is generally desired to optimize the conditions in order to produce a fine, tight loop size. One way to facilitate this is to increase the gauge of the machine's needles used to knit the fabric (that is, use finer needles). For example the fabric may be made with 28, 32, 36, 40 or higher gauge in a warp knitting process, or 22, 24, 28, 32 or higher gauge in a circular knitting process. Another way to encourage the production of fabric having a tight loop size is to optimize the feed rate for the first yarn and the second yarn. For warp knitting it has been discovered that good results can be obtained using a feed rate for both the elastic fiber and the hard yarn/fiber from 100 to 5000 mm per rack, preferably 200 to 4000 mm per rack and most preferably 300 to 3000 mm per rack. For circular knitting it has been discovered that good results can be obtained using a feed rate for the hard yarn/fiber in the range of 1.0 to 110 mm/needle, preferably in the range of 1.2 to 6 mm/needle and most preferably in the range of 1.5 to 4 mm/needle. The elastic fiber for circular knitting is ideally fed such that the ratio of hard yarn feeding rate to elastic fiber feeding rate is in the range of 1.0 to 7, preferably 1.2 to 5 and most preferably 1.5 to 4.

The fabrics of the present invention can also be improved by using various finishing steps. These include scouring, which is a wash in a surfactant solution in a temperature range of from about 20° C. to about 95° C. The scouring process can be a discontinuous process in which the fabric can be treated in rope or in open-width forms in jet or over flow or soft flow or beam-autoclave machines. The discontinuous process also includes treating the finished garment in, for example, a tumble washing machine. The scouring process can also be a continuous process where the fabric is treated in open-width form.

Another finishing step is a dyeing step which includes acid, disperse reactive, metal complex, vat dyeing technologies.

Yet another finishing step is drying which may be conducted in a tenter frame on a belt dryer or tumble dryer typically in a range of 100° C. to 190° C. with a residence time of 5 second to 1000 seconds.

Still another finishing step, particularly depending upon the hard fiber used, may be a heat-setting step. Heat setting steps may be carried out in a tenter frame (for treating fabric in the open-width form) or in a steamer (for treating the garment, or the fabric in open-width or tubular form). Typical temperatures range from 100° C. to 230° C. with residence times from 5 to 1000 seconds.

Another finishing step is printing, which may include rotary or flat screen printing and/or transfer printing machines for direct printing technologies which can be followed by a fabric steaming process for fixing the dyestuff involved, and a washing step to remove the unfixed dyestuff. Printing may also include digital printing.

The fabrics of the present invention can be characterized according to several mechanical properties, such as Elongation, Growth, Modulus, Fabric Width, Fabric Density and Dimensional Stability. It is preferred that the fabrics of the present invention have an Elongation greater than 90 percent, preferably greater than 100%, 110%, 130% or even 150% with a practical limit of less than about 300%; Growth after 1 minute at 15% strain less than 7% (preferably less than 5%, more preferably less than 4%); Modulus between 20 and 1000, (preferably between 50 and 700); Fabric density between 100 and 300 (preferably between 140 and 250); and a Dimensional Stability of ±7%, (preferably ±6%, more preferably 5%) in each of the length and width directions of the fabric.

Another aspect of the present invention is a garment, particularly swimwear, made from the preferred fabric of the invention. The garments of the present invention will benefit from the fabrics and therefore can be characterized as having low Growth, good Dimensional Stability and a Modulus as described for the preferred fabrics.

Another aspect of the present invention is a method for making a dimensionally stable elastic fabric comprising combining a first fiber which is a crosslinked polyolefin fiber of from 11 to 99 dtex, and a second fiber selected from the group consisting of polyester, nylon, and polypropylene which second fiber is a fiber of from 22 to 176 dtex under knitting conditions suitable to produce a fine tight loop. The knitting process may be either a warp knitting or a circular knitting process.

The fabrics of this invention can additionally contain antimicrobial treatments for odor control or moisture management systems to provide liquid transfer across the fabric by changing the hydrophilic nature of the fiber or other treatments. These modifications can be introduced at the fiber level or during the fabric finishing steps at the fabric level.

When a warp knitting process is used, it is preferred that the knitting machine use greater than 28 gauge needles, with 32, 36, 40 or higher being preferred in certain applications. It is also preferred that the feed rate for the both the first yarn and the second yarn is from 100 to 5000 mm per rack in such processes, more preferably 200 to 4000 mm per rack, and even more preferably 300 to 3000 mm per rack.

When a circular knitting process is used, it is preferred that the knitting machine use greater than 22 gauge needles, with 24, 28, 32, or higher being preferred in certain applications. It is also preferred that the feed rate for the second yarn be in the range of from 1 to 10 mm/needle, preferably between 1.2 and 6 mm/needle, more preferably between 1.5 and 4 mm/needle. It is preferred that the feed rate for the first yarn be such that the ratio of the feed rate of the second yarn to the feed rate of the first yarn is in the range of 1 to 7, preferably 1.2 to 5.0 and more preferably between 1.5 and 4.

EXAMPLES

The following fibers were used to make a series of fabrics (The "first" yarns where selected from Yarn A, Yarn B or Yarn C, while the "second" yarn was selected from Yarns D-K):

Yarn A: A substantially linear ethylene-octene copolymer having an $I_2$ of 3 g/10 minutes as determined by ASTM D-1238 (190° C., 2.16 kg) and a density of 0.875 g/cm$^3$ as measured by ASTM D-792 was melt spun to make monofilament 78 dtex elastic fiber and crosslinked by e-beam to a 65% gel level. The melting peak for this yarn is ~70° C. as measured by DSC at a heating rate of 10° C./min.

Yarn B is the same as Yarn A except that it is a round monofilament 44 dtex fiber.

Yarn C is the same as Yarn B except that it is 22 dtex fiber.

Yarn D is a substantially linear ethylene-octene copolymer having an $I_2$ of 1.3 g/10 minutes as determined by ASTM D-1238 (190° C., 2.16 kg) and a density of 0.890 g/cm$^3$ as measured by ASTM D-792 which was melt spun to make monofilament 44 dtex elastic fiber and crosslinked by e-beam to a 65% gel level. The melting peak for this yarn is approximately 120° C. as measured by DSC at a heating rate of 10° C./min.

Yarn E: Flat PES (PET polyester) 45 dtex/46 filaments.

Yarn F: Flat PA6 (also known as "Nylon 6") 44 dtex/10 filaments.

Yarn G: PTT (poly(trimethylene) terephthalate polyester) 44 dtex/10 filament.

Yarn H: Flat black polypropylene 44 dtex/30 filaments.

Yarn I: Flat PES 78 dtex/72 filaments micro PES.

Yarn J: PTT 44 dtex/12 filaments.)

Yarn K: Textured PES 50 dtex/72 filaments.

Yarn L: Textured twin 156 PA66 dtex (2 ply 78 dtex).

Yarn M: Textured black 55 dtex/48 filaments (1 ply 55 dtex) Polypropylene from Tri-Ocean In all of the Examples the instantaneous Growth is reported (that is, the growth measured after 1 minute of releasing the biasing force).

Example 1

Comparative

Beaming: 1340 ends warp knit beams are produced with Yarn A. The beams are produced with a pre-draft of 2.1× and a final draft of 1.4× in a warping machine from LIBA. Yarn E is beamed into 1328 ends per beam.

Knitting: The elastic and rigid yarn beams are placed on a 32 gauge ("32 G") Tricot knitting machine. The knitting conditions are 650 mm/rack for Yarn A and 1480 mm/rack for Yarn E. A locknit fabric construction is used.

A finishing process of scouring, followed by dyeing the fabric black, followed by heat setting is then performed on the resulting fabric.

The properties associated with this fabric are given in Table 1. The growth is measured in water.

Example 2

Comparative

Beaming: 1372 ends (beans 21×42") warp knit beams are produced with Yarn B. The beams are produced with a pre-draft of 2.5× and a final draft of 2× in a Karl Mayer warping machine. The pre-draft and draft conditions are selected to avoid barre in the final product. Yarn F is beamed into 1360 ends beam.

Knitting: The elastic and rigid yarn beams are placed on a 32 G Tricot knitting machine. The knitting conditions used are 600 mm/rack for Yarn B and 1300 mm/rack for Yarn F. A locknit fabric construction was used.

A finishing process of scouring, followed by dyeing the fabric cobalt blue, followed by heat setting is then performed on the resulting fabric.

The properties associated with this fabric are given in Table 1. The growth is measured in water.

Example 3

Comparative

Beaming: 1376 ends warp knit beams are produced with Yarn B. The beams are produced with a pre-draft of 2.5× and a final draft of 2× in a warping machine from Karl Mayer. Yarn G was beamed into 1368 ends beams.

Knitting: The elastic and rigid yarn beams are placed on a 32 G Tricot knitting machine. The knitting conditions used are 800 mm/rack for Yarn B and 1300 mm/rack for Yarn G. A locknit fabric construction is used.

A finishing process of scouring, followed by dyeing the fabric cobalt blue, followed by heat setting is then performed on the resulting fabric.

The properties associated with this fabric are given in Table 1. The growth is measured in water.

Example 4

Comparative

Beaming: 1360 ends warp knit beams are produced with Yarn B. The beams are produced with a pre-draft of 2.3× and a final draft of 1.8× in a warping machine from LIBA. Yarn H is beamed into 1340 ends beams.

Knitting: The elastic and rigid yarn beams are placed on a 32 G Tricot knitting machine. The knitting conditions used are 600 mm/rack for Yarn B and 1400 mm/rack for Yarn H. A locknit fabric construction is used.

A finishing process of scouring, followed by drying is then performed on the resulting fabric.

The properties associated with this fabric are given in Table 1. The growth is measured in water.

Example 5

Beaming: 1560 ends warp knit beams are produced with Yarn B. The beams are produced with a pre-draft of 2.5× and a final draft of 2× in a Karl Mayer warping machine. Yarn I is beamed into 1548 ends beams.

Knitting: The elastic and rigid yarn beams are placed on a 36 G Tricot knitting machine. The knitting conditions used are 700 mm/rack for Yarn B and 1300 mm/rack for Yarn I. A locknit fabric construction was used.

A finishing process of scouring, followed by dyeing the fabric purple, followed by heat setting is then performed on the resulting fabric.

The properties associated with this fabric are given in Table 1. The growth is measured in water.

Example 6

Beaming: 1560 ends warp knit beams are produced with Yarn C. The beams are produced with a pre-draft of 2× and a final draft of 1.5× in a Karl Mayer warping machine. Yarn I is beamed into 1548 ends beams.

Knitting: The elastic and rigid yarn beams are placed on a 36 G Tricot knitting machine. The knitting conditions used are 800 mm/rack for Yarn C and 1300 mm/rack for Yarn I. A locknit fabric construction is used.

A finishing process of scouring, followed by dyeing the light yellow, followed by heat setting is then performed on the resulting fabric.

The properties associated with this fabric are given in Table 1. The growth is measured in water.

Example 7

Beaming: 1556 ends (beams 21×42") warp knit beams are produced with Yarn B. The beams are produced with a pre-draft of 2.5× and a final draft of 2× in a Karl Mayer warping machine. Yarn F was beamed into 1540 ends beams Knitting: The elastic and rigid yarn beams are placed on a 36 G Tricot knitting machine. The knitting conditions used are 600 mm/rack for Yarn B and 1250 mm/rack for Yarn F. A locknit fabric construction is used.

A finishing process of scouring, followed by dyeing the fabric cobalt blue, followed by heat setting is then performed on the resulting fabric.

The properties associated with this fabric are given in Table 1. The growth is measured in water.

Example 8

Beaming: 1560 ends warp knit beams are produced with Yarn B. The beams are produced with a pre-draft of 2× and a final draft of 1.5× in a Karl Mayer warping machine. Yarn J is beamed into 1548 ends beams.

Knitting: The elastic and rigid yarn beams are placed on a 36 G Tricot knitting machine. The knitting conditions used are 800 mm/rack for Yarn B and 1300 mm/rack for Yarn J. A locknit fabric construction is used.

A finishing process of scouring, followed by dyeing the fabric dark pink, followed by heat setting is then performed on the resulting fabric.

The properties associated with this fabric are given in Table 1. The growth is measured in water.

Example 9

Beaming: 1560 ends warp knit beams are produced with Yarn B. The beams are produced with a pre-draft of 2.5× and a final draft of 2× in a Karl Mayer warping machine. Yarn K is beamed into 1548 ends beams.

Knitting: The elastic and rigid yarn beams are placed on a 32 G Tricot knitting machine. The knitting conditions used are 700 mm/rack for Yarn B and 1400 mm/rack for Yarn K. A locknit fabric construction is used.

A finishing process of scouring, followed by dyeing the fabric purple, followed by heat setting is then performed on the resulting fabric.

The properties associated with this fabric are given in Table 1. The growth is measured in water.

Example 10

Knitting: Circular knitting with a feeding rate for Yarn L of 3.1 mm/needle and a ratio of Yarn L/Yarn A Feeding Rates of 2.8. The machine Gauge is 28 G, and the structure is a Plain Single Jersey.

A finishing process of scouring, followed by dyeing the fabric purple, followed by heat setting is then performed on the resulting fabric.

The properties associated with this fabric are given in Table 1. The growth is measured in water.

Example 11

Knitting: Circular knitting with a feeding rate for Yarn M of 3.1 mm/needle and a ratio of Yarn M/Yarn D Feeding Rates of 3.3. The machine Gauge is 32 G, and the structure is a Plain Single Jersey.

A finishing process of scouring in jet at 90° C. followed by heat setting at 130° C. for 1 minute in a stenter frame.

The properties associated with this fabric are given in Table 1. The growth is measured in water.

TABLE 1

| Property | Ex 1 | Ex 2 | Ex 3 | Ex 4 | Ex 5 | Ex 6 | Ex 7 | Ex 8 | Ex 9 | Ex 10 | Ex 11 |
|---|---|---|---|---|---|---|---|---|---|---|---|
| $M_f$, cN | 192 | 207 | 95 | 115 | 397 | 506 | 219 | 265 | 152 | 133 | 15 |
| $E_f$, %- | 207 | 234 | 246 | 195 | 152 | 141 | 198 | 171 | 218 | 264 | 420 |
| Finished Fabric weight, g/m$^2$ | 200 | 200 | 195 | 170 | 256 | 247 | 200 | 184 | 230 | 199 | 152 |
| Finished Fabric width, cm | 151 | 142 | 152 | 163 | 154 | 169 | 143 | 140 | 155 | 144 | 149 |
| Width Dimensional Stability, % | −6 | −6 | −4 | −5 | −2 | −3 | −2 | −4 | −4 | −2 | −3.3 |
| Length Dimensional Stability, % | −13 | −9 | −8 | −11 | −2 | −2 | −3 | −4 | −6.5 | −1 | −3.2 |
| $G_f$@ 15% strain, % | 7 | 4 | 8 | 13 | 5 | 6 | 7 | 6 | 5 | 5 | 6.3 |
| $G_f$@ 25% strain, % | 8 | 8 | 9 | 16 | 8 | 11 | 11 | 9 | 7 | 5 | 7.4 |
| $G_f$@ 35% strain, % | 15 | 13 | 14 | 18 | 12 | 16 | 15 | 12 | 10 | 6 | 10.8 |

What is claimed is:

1. An elastic fabric characterized in that it has an Elongation greater than 90%, an instantaneous overall fabric growth (wet) at 15% strain of 15% or less, a Dimensional Stability for the length of within ±7%, a Dimensional Stability for the width of within ±7%, wherein the fabric comprises from 6% to 50% by weight of a first yarn which is an elastic crosslinked polyolefin fiber, and from 50 to 94% by weight of a second yarn which is a fiber selected from the group consisting of polyester, nylon, and polypropylene.

2. The fabric of claim 1 wherein the crosslinked polyolefin fiber is from 11 to 99 dtex and the second yarn is from 22 to 176 dtex.

3. The fabric of claim 1 wherein the first yarn is a polyethylene fiber that has been crosslinked.

4. The fabric of claim 3 wherein the first yarn is a crosslinked substantially linear homogeneously branched polyethylene fiber.

5. The fabric of claim 3 wherein the first yarn is a crosslinked linear homogeneously branched polyethylene fiber.

6. The fabric of claim 1 wherein the first yarn is a monofilament fiber.

7. The fabric of claim 1 wherein the first yarn is from 22 to 88 dtex.

8. The fabric of claim 1 wherein the second yarn is a textured fiber.

9. The fabric of claim 1 wherein the Elongation is greater than 100%.

10. The fabric of claim 1 wherein the instantaneous overall fabric growth at 15% strain is 7% or less.

11. The fabric of claim 1 wherein the instantaneous overall fabric growth at 15% strain is 5% or less.

12. The fabric of claim 1 wherein the Dimensional Stability for each of the length and width is ±6%.

13. A garment made from the fabric of claim 1.

14. A method for making a dimensionally stable elastic fabric comprising combining in a knitting process a first yarn which is a crosslinked polyolefin fiber of from 11 to 99 dtex, and a second yarn selected from the group consisting of polyester, nylon, and polypropylene which second yarn is a yarn of from 22 to 176 dtex under knitting conditions selected to minimize the loop size.

15. The method of claim 14 where the knitting process is a warp knitting process.

16. The method of claim 15 where the knitting process uses a knitting machine having needles of greater than 28 gauge.

17. The method of claim 16 where the knitting process uses a feed rate for the both the first yarn and the second yarn of from 300 to 3000 mm per rack.

18. The method of claim 14 where the knitting process is a circular knitting process.

19. The method of claim 18 where the knitting process uses a knitting machine having needles of greater than 22 gauge.

20. The method of claim 18 where the second yarn has a feed rate in the range of from 1 to 10 mm/needle and the first yarn has a feed rate such that the ratio of the feed rate of the second yarn to the feed rate of the first yarn is in the range of 1 to 7.

* * * * *